US006254208B1

(12) United States Patent
Samsel

(10) Patent No.: US 6,254,208 B1
(45) Date of Patent: Jul. 3, 2001

(54) STORAGE CHEST WITH TILTABLE SHELF

(75) Inventor: Richard A. Samsel, Haines, FL (US)

(73) Assignee: Delta Consolidated Industries, Raleigh, NC (US)

( * ) Notice: Subject to any disclaimer, the term of this patent is extended or adjusted under 35 U.S.C. 154(b) by 0 days.

(21) Appl. No.: 09/356,922

(22) Filed: Jul. 19, 1999

(51) Int. Cl.[7] ..... A47B 81/00

(52) U.S. Cl. ..... 312/290; 312/244; 312/313; 206/386

(58) Field of Search ..... 312/126, 128, 312/136, 291, 310, 313, 327, 351, 902, 250, 244; 211/80, 116, 150, 168, 169; 220/531, 527; 248/240.1, 240; 292/278, 263; 206/373, 386

(56) References Cited

U.S. PATENT DOCUMENTS

| | | | | |
|---|---|---|---|---|
| 2,819,908 | * | 1/1958 | Jackson et al. | 211/150 X |
| 3,875,871 | * | 4/1975 | Thornton et al. | 220/531 X |
| 3,981,552 | * | 9/1976 | Karashima | 312/126 X |
| 4,288,134 | * | 9/1981 | Knaack et al. | 312/290 X |
| 4,383,721 | * | 5/1983 | Knaack et al. | 312/290 X |
| 6,039,419 | * | 3/2000 | Brown et al. | 312/258 X |

OTHER PUBLICATIONS

Knaack Catalog; No. K878.*

* cited by examiner

*Primary Examiner*—Janet M. Wilkens

(74) *Attorney, Agent, or Firm*—Myers Bigel Sibley & Sajovec

(57) ABSTRACT

A storage chest comprises: opposing front and rear walls; opposing side walls connecting the front and rear walls, wherein each of the side walls includes a recess having upper and lower horizontal surfaces and a vertical panel extending therebetween; and a shelf including a main panel. The shelf is pivotally attached to at least one of the rear wall, front wall and side walls and is movable between a raised position, in which the main panel is generally upright, with a front edge of the main panel being located above the rear edge, and a lowered position, in which the main panel is generally horizontally disposed and the shelf rests upon the upper horizontal surfaces of the side wall recesses. In this configuration, the shelf can be moved to the raised position so that the lower rear portion of the cavity defined by the front, rear and side walls can be easily accessed and can be used to store items that would not fit beneath a permanently mounted shelf. In a preferred embodiment, handles are mounted within the recesses of the chest. This configuration enables the shelf to capitalize on this already-present feature of storage chests without requiring additional structure to support the shelf in its lowered position. It is also preferred that the chest include a retaining unit, such as a retaining arm, that retains the shelf in the raised position as desired.

20 Claims, 7 Drawing Sheets

STORAGE CHEST WITH TILTABLE SHELF

FIELD OF THE INVENTION

The present invention relates generally to storage chests, and more particularly to metal storage chests with internal shelves.

BACKGROUND OF THE INVENTION

Large storage chests often used in the construction industry are typically formed of steel sheet. The floor and walls of the chest can be formed either from a single sheet of steel that is bent at intersecting edges of the walls and floor to form a box or from multiple pieces of sheet steel that are welded together into a box. Tools can then be stored within the cavity of the box. Typical sizes for such a chest can range from 2 $ft^3$ to 8 $ft^3$ or even larger.

Because it is often desirable for the chest to be at least somewhat portable, the walls may include pivoting carrying handles, which may be mounted to a straight wall or fold within a recess formed in the wall. Chests with recesses for the handles often include a shelf that is mounted upon the upper surfaces of the recess. Typically such a shelf is mounted to the rear wall as well as the recesses and extends forwardly a significant distance toward the front wall of the chest. One such chest is described in U.S. Pat. No. 4,288,134 to Weger, the disclosure of which is hereby incorporated herein by reference in its entirety. As described in Weger, a shelf welded directly onto the recess not only provides storage space for the chest, but also reinforces and "rigidities" the walls of the chest.

Of course, this configuration has at least two potential shortcomings. First, the permanent presence of the shelf precludes the storage of items in the rear portion of the chest that are taller than the distance between the floor of the chest and the shelf. Second, items that are stored beneath the shelf can be somewhat difficult to access, particularly if the shelf is at a height equal to or lower than the height of the front wall. As a result of these shortcomings, the usefulness of the storage space beneath the shelf can be somewhat limited.

SUMMARY OF THE INVENTION

In view of the foregoing, it is an object of the present invention to provide a storage chest having an internal shelf that allows the storage of large items, and particularly items that are taller than the height of the shelf.

It is also an object of the present invention to provide a storage chest with an internal shelf wherein items stored below the shelf can be accessed easily.

These and other objects are satisfied by the present invention, which is directed to a storage chest having a pivoting shelf. More specifically, the storage chest of the present invention comprises: opposing front and rear walls; opposing side walls connecting the front and rear walls, wherein at least one of the side walls includes a recess having upper and lower horizontal surfaces and a vertical panel extending therebetween; and a shelf including a main panel. The shelf is pivotally attached to at least one of the rear wall, front wall and side walls and is movable between a raised position, in which the main panel is generally upright, with a front edge of the main panel being located above the rear edge, and a lowered position, in which the main panel is generally horizontally disposed and the shelf rests upon the upper horizontal surfaces of the side wall recesses. In this configuration, the shelf can be moved to the raised position so that the lower rear portion of the cavity defined by the front, rear and side walls can be easily accessed and can be used to store items that may not fit beneath a permanently mounted shelf.

In a preferred embodiment, handles are mounted within the recesses of the chest. This configuration enables the shelf to capitalize on this already-present feature of storage chests without requiring additional structure to support the shelf in its lowered position. It is also preferred that the chest include a retaining unit, such as a retaining arm, that retains the shelf in the raised position as desired.

DETAILED DESCRIPTION OF THE INVENTION

The present invention now will be described more filly hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art.

Figure 1:
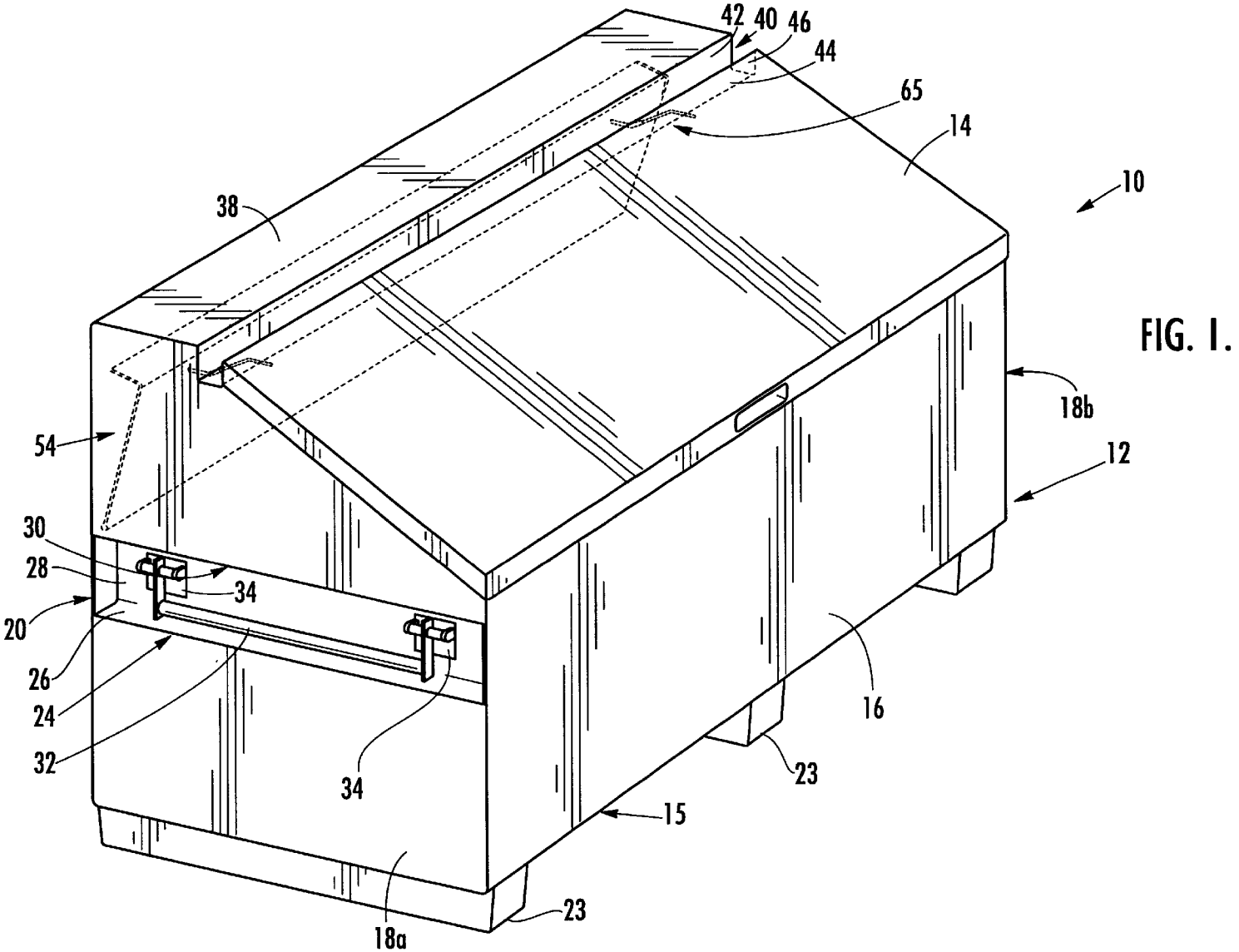
FIG. 1 is a perspective view of a chest of the present invention showing the cover in its closed position and the shelf (in phantom line) in its raised position.

Referring now to FIG. 1, a storage chest, designated broadly at 10, is illustrated therein. The chest 10 generally includes a container 12 and a cover 14. The container 1:2 includes a rectangular floor 15 from which rise a front wall 16, side walls 18*a*, 18*b* (see also FIG. 2), and a rear wall 20. The floor 22 is supported by feet 23. A partial ceiling 38 is fixed to the upper edges of the side walls 18*a*, 18*b* and the rear wall 20. The floor 15 and walls 16, 18*a*, 18*b* and 20 of the container 12 are preferably formed of sheet steel or sheet aluminum having a thickness of between about 0.0299 and 0.1875 inches.

Those skilled in this art will recognize that, although the rectangular shape of the container 12 illustrated herein is preferred, other configurations, such as one in which the container 12 has a square footprint or a rectangular footprint of different dimensions, can also be used with the present invention. An exemplary alternative configuration is a chest (often referred to as a "piano box" chest) that has a two-piece lid that is hinged at its rear edge to the container rear wall and that covers both the top edges of the side walls and an upper opening in the front wall. Exemplary piano box chests are shown in Weger and are also available from Delta Consolidated Industries, Jonesboro, Ark., under the trademark JOBOX®. Other configurations, such as a more conventional box-shaped chest, may also be employed with the present invention.

Formed within each of the side walls 18*a*, 18*b* is a respective recess 24, each of which comprises a lower panel 26, a vertical panel 28 and an upper panel 30. A handle 32 is mounted within each recess 24 via a pair of handle brackets 34. The recess 24 in the side wall 18*b* and the associated handle 32 are not shown in the figures but are constructed as a mirror image of the recess 24 and the handle 32 in the side wall 18*a*. Recesses and handles of this type are described in detail in Weger. Although illustratively and preferably the recesses 24 are formed within a unitary sheet that forms, each side wall 18*a*, 18*b*, those skilled in this art will recognize that the recesses can be formed with multiple pieces that are separate from the side walls 18*a*, 18*b*.

As noted above, the ceiling 38 is mounted to the upper edges of the side walls 18*a*, 18*b* and the rear wall 20. At its front edge, the ceiling 38 merges with a U-shaped channel 40, which comprises generally vertically-disposed rear and front panels 42, 46 and a horizontal panel 44 that extends between the lower edges of the rear and front panels 42, 46. The front panel 46 meets the rear edge of the cover 14 when the cover 14 is in its closed position.

Figure 2:
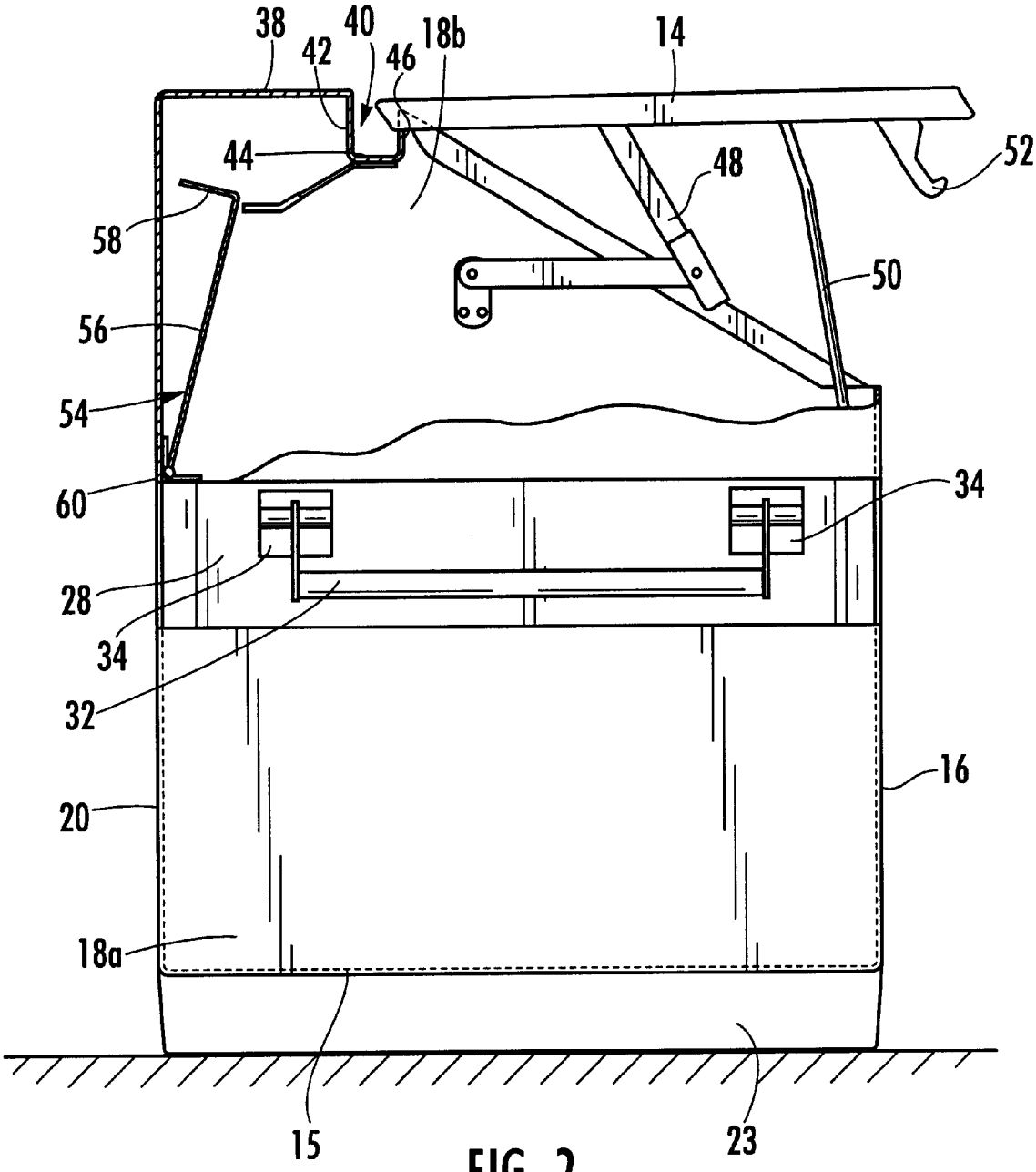
FIG. 2 is a cutaway side view of the chest of FIG. 1 with the cover shown in its open position and the shelf shown in its raised position.

As shown in FIG. 2, movement of the cover 14 relative to the container 12 is controlled by linkages 48 (only one of which is illustrated herein). Each linkage 48 is pivotally mounted to an upper portion of a respective side wall 18*a*, 18*a* and to the underside of the cover 14. Although the rear edge of the cover 14 meets the upper edge of the channel front panel 46, the rear edge of the cover 14 is not attached directly to the front panel 46; instead, as the cover 14 is raised from its closed position (in which, as shown in FIG. 1, the front edge of the cover 14 is 30 positioned lower than the rear edge, as is characteristic of a "slope-lid". style chest) to an open position, the cover 14 slides rearwardly relative to the upper edge of the front panel 46 and eventually enters the channel 40. The cover 14 can be maintained in a partially open position (shown in FIG. 2) with the aide of a support rod 50 that is pivotally attached to the underside of the cover 14 and that can rest on a structure (not shown) that is mounted within the container 12. The cover 14 also includes a latch 52 for maintaining the cover in a closed position.

Those skilled in this art will appreciate that other cover configurations, including those in which the rear edge of the cover 14 is pivotally attached to the ceiling 38 directly, may also be included with the present invention. In addition, the ceiling 38 may be omitted entirely, and the cover 14 can be pivotally attached to the rear wall 20 or to other structures on the container 12 via hinges or other pivotal interconnection. means, such as mechanical linkages.

Figure 3:
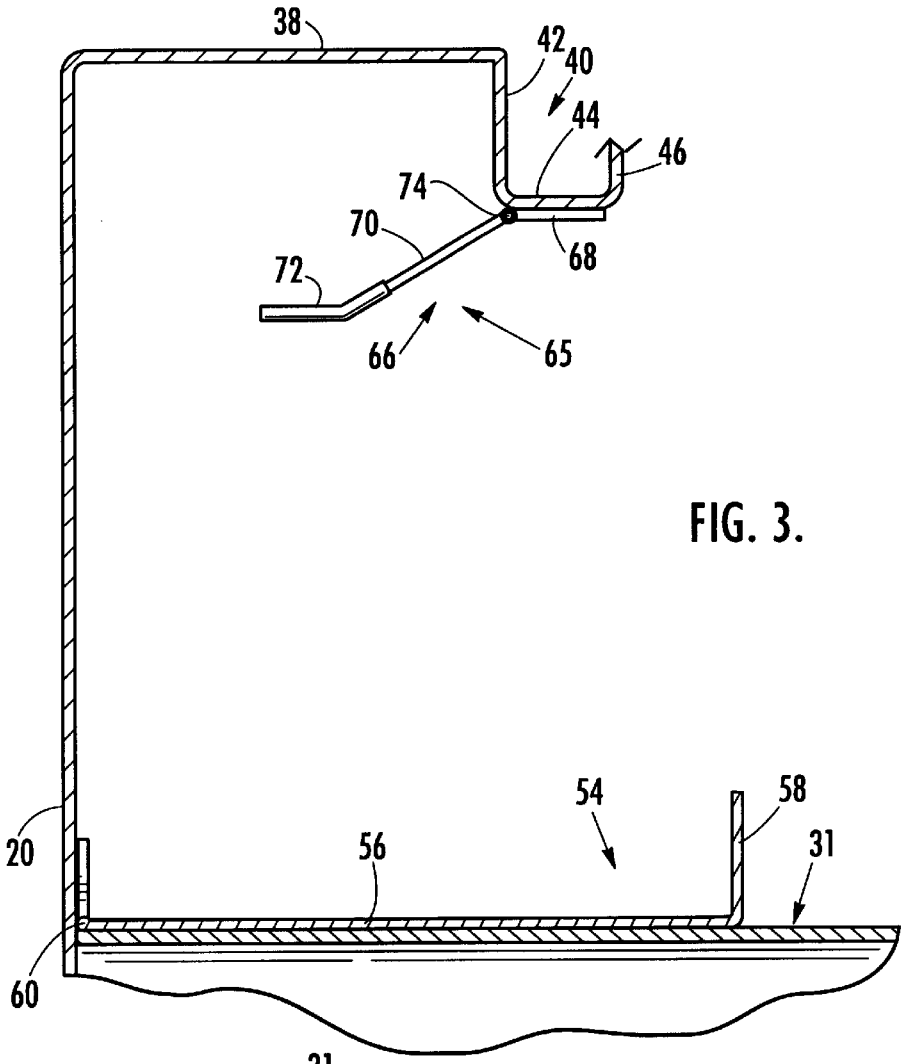
FIG. 3 is an enlarged partial side section view of the chest of FIG. 1 showing the shelf in its lowered position.

Referring now to FIG. 3, a shelf 54 resides within the container 12. The shelf 54 includes a generally horizontally disposed main panel 56 and a lip 58 that merges with and extends upwardly from the front edge of the main panel 56. At its rear edge, the shelf 54 is hinged to the rear wall 20 via a pivoting shelf bracket 60, although the pivotal interconnection can be achieved via other means, such as mechanical linkages and the like, that can be mounted to either the rear wall 20 or the side walls 18*a*, 18*b*. The shelf 54 extends the entire width of the container 12 (i.e., the shelf 54 spans the distance between the side walls 18*a*, 18*b*).

Figure 4:
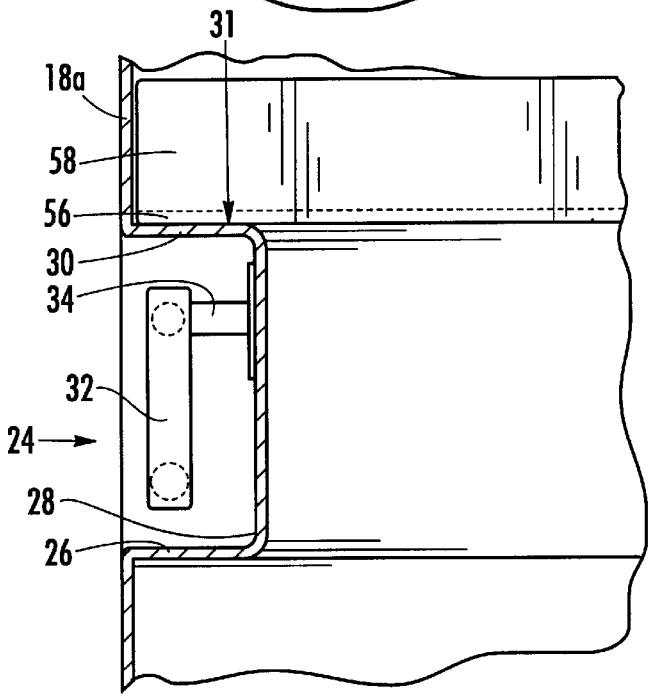
FIG. 4 is an enlarged partial front section view of the chest of FIG. 1 showing the shelf in its lowered position.

As can be seen in FIGS. 3 and 4, the shelf 54 is mounted onto the rear wall 20 at a height such that, when it is in a lowered position, the shelf 54 rests upon and is supported by the upper surface 31 of the recess upper panel 30. In the lowered position, the shelf 54 provides valuable storage space within the container 12, particularly for smaller items that might otherwise become lost or misplaced in a large container.

A retainer unit 65 having a retaining arm 66 is mounted to the underside of the channel 40. The retaining arm 66 has a tripartite structure and includes a forward portion 68, an intermediate portion 70, and a rear portion 72 that serially merge with one another at oblique angles. As illustrated in FIG. 3, the retaining arm 66 is pivotally attached to the underside of the channel 40 via a hinge 74 that is located generally at the intersection between the forward and intermediate portions 68, 70 of the retaining arm 66 and below the rear panel 42 of the channel 40.

When the shelf 54 is in its lowered position, the retaining arm 66 takes the position illustrated in FIG. 3, in which the forward portion 68 rests and presses against the underside of the channel horizontal panel 44. The intermediate and rear portions 70, 72 of the retaining arm 66 have sufficient weight that this position of the retaining arm 66 is maintained unless some additional force acts upon the retaining arm 66.

Figure 5:
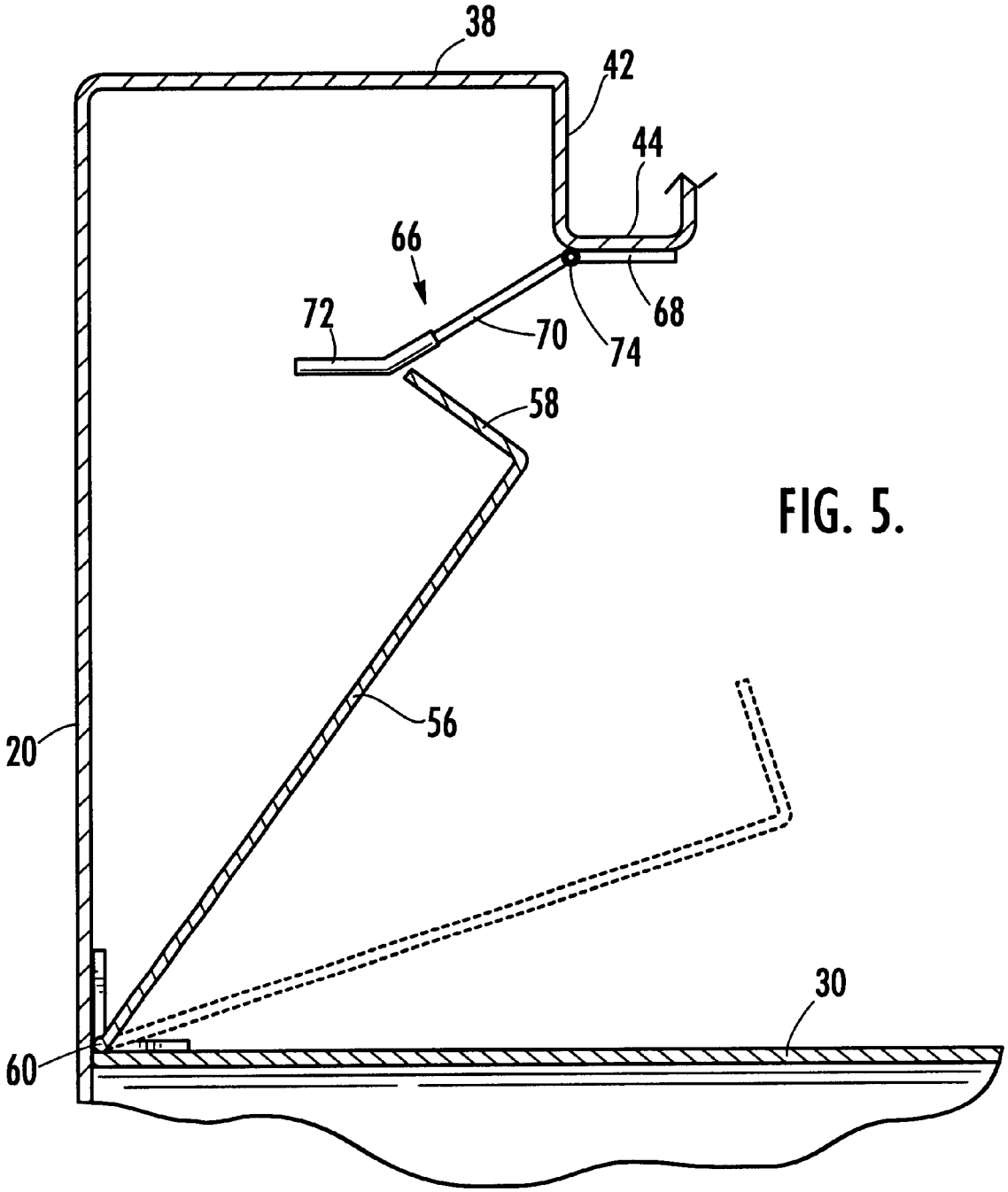
FIG. 5 is an enlarged partial side section view of the shelf of FIG. 3 showing the shelf moving toward its raised position.
Figure 6:
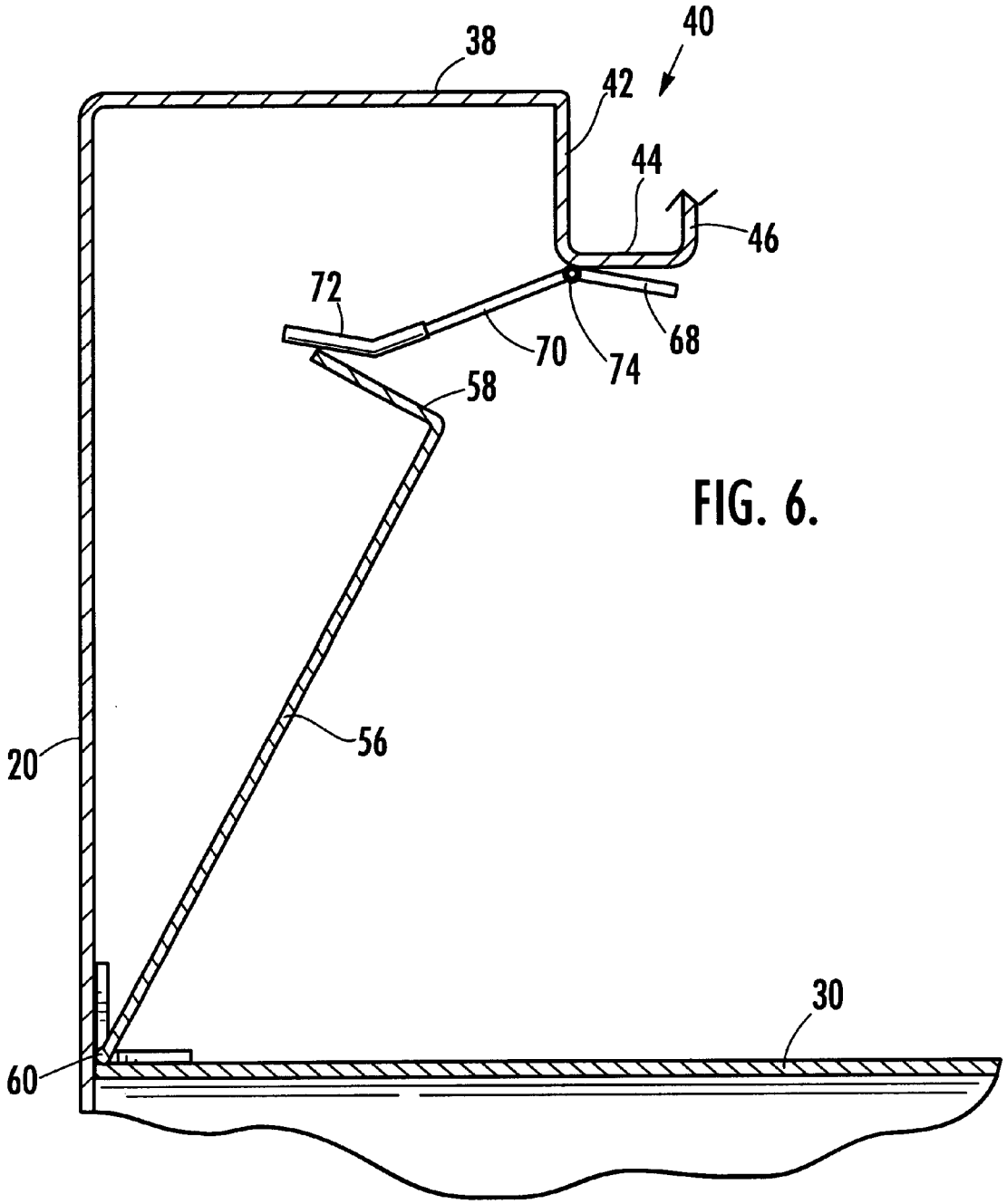
FIG. 6 is an enlarged partial side section view of the shelf of FIG. 3 showing the shelf moving to its raised position and illustrating the pivoting of the retaining arm.
Figure 7:
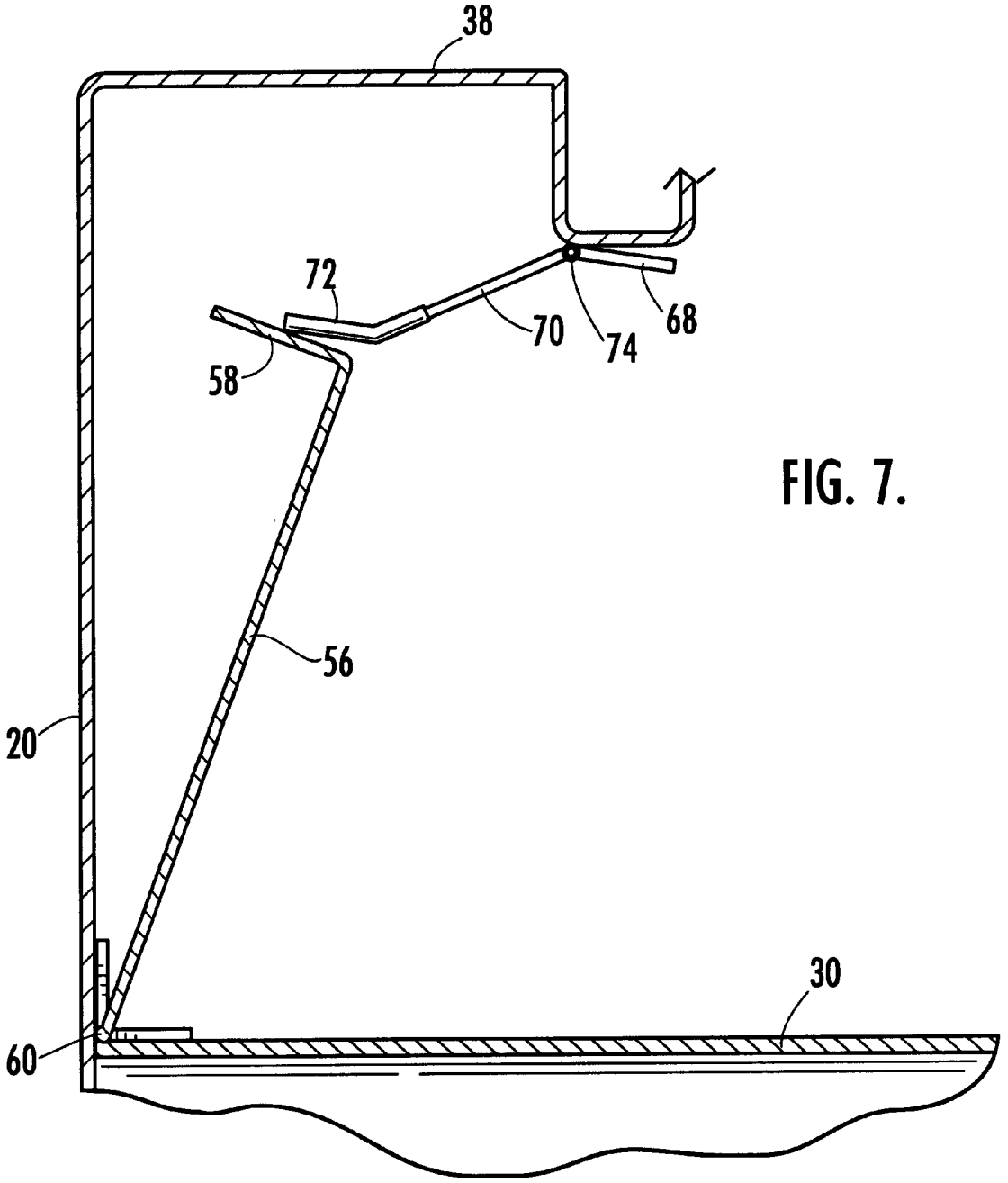
FIG. 7 is an enlarged partial side section view of the shelf of FIG. 3 showing the shelf continuing to move to its raised position.
Figure 8:
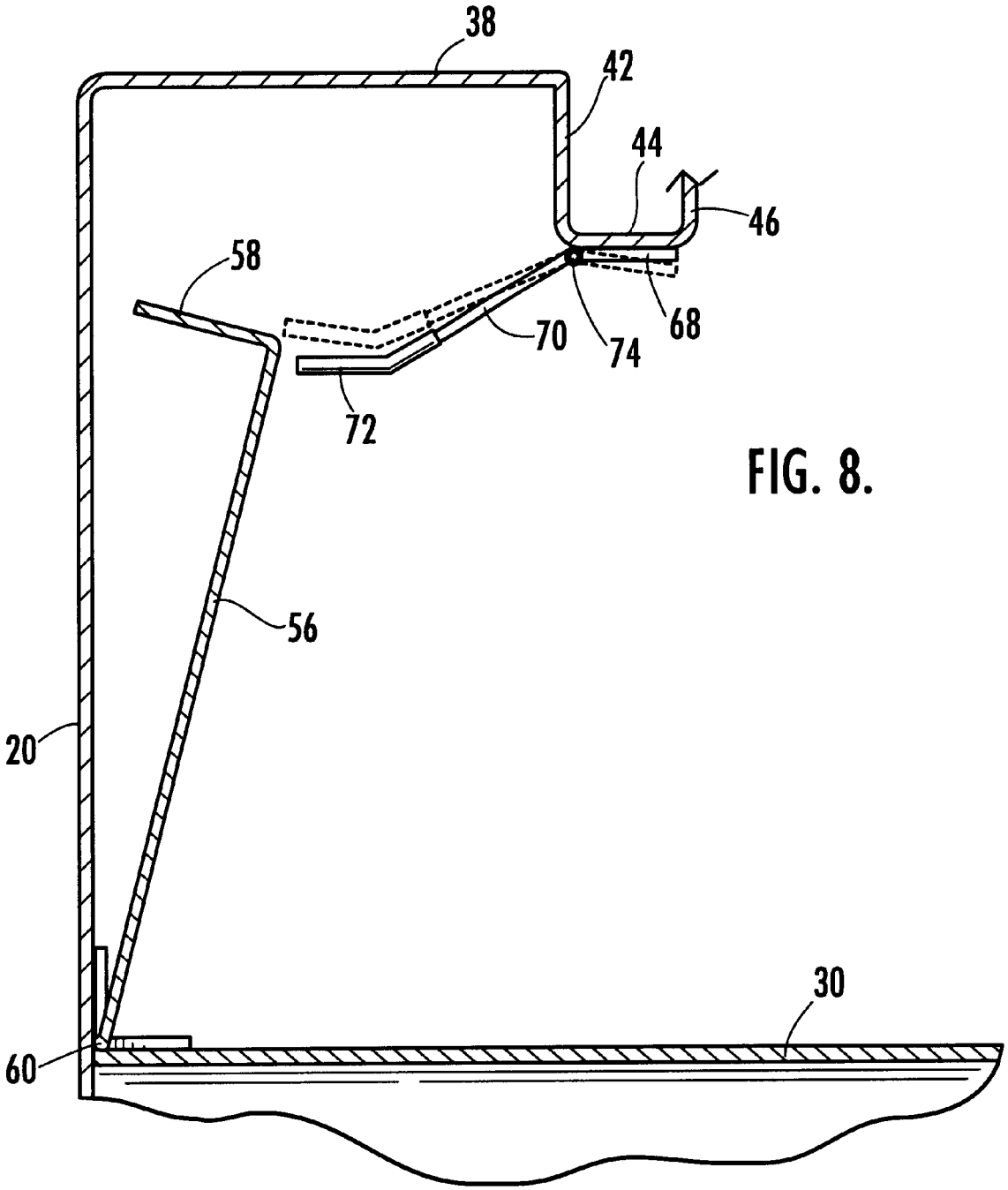
FIG. 8 is an enlarged partial side section view of the shelf of FIG. 3 showing the shelf in its raised position and illustrating how the retaining arm pivots to its original position to maintain the shelf in the raised position.

FIGS. 5 through 8 illustrate the interrelated pivotal movements of the shelf 54 and retaining arm 66 as the shelf 54 travels to its raised position, in which the front edge of the main panel 56 is positioned above the rear edge thereof. In FIG. 5, the shelf 54 has been raised from its resting position on the upper panel 30 of the recess 24, but has not yet reached the retaining arm 66. In FIG. 6, the lip 58 of the shelf 54 has contacted the rear portion 72 of the retaining arm 66, causing the retaining arm 66 to pivot about the hinge 74 such that the forward portion 68 rotates away from the channel horizontal panel 44 (in a clockwise direction as viewed from the vantage point of FIG. 6). This rotation continues (see FIG. 7) as the shelf 54 travels to its raised position until the support panel 56 has traveled upwardly and rearwardly beyond the reach of the retaining arm rear portion 72. At that point, the weight of the intermediate and rear portions 70, 72 of the retaining arm 66 causes the retaining arm 66 to pivot rapidly back to its original position, with its forward portion 68 resting against the channel horizontal panel 44. In this position, the rear portion 72 of the retaining arm 66 contacts the shelf 54 and maintains it in its upright position until the retaining arm 66 is manually pivoted (shown in phantom line in FIG. 8) to enable the shelf 54 to return to its lowered position. In the raised position, the shelf 54 is positioned so that the rear lower portion of the storage cavity within the container 12 can be accessed easily by someone position in front of the front wall 16 of the container 12.

Those skilled in this art will recognize that, although the illustrated retainer unit configuration is preferred, other configurations that retain the shelf in its raised position may also be employed with the present invention. For example, a similarly shaped retainer arm may be mounted to one or both side walls of the container. Also, a similarly shaped retainer arm may be fixed to the ceiling or side walls and simply deflect out of the path of the shelf 54 as it moves between positions. Moveover, clips can be mounted on the side or rear walls to retain the shelf in place. In addition, the shelf 54 may be held in its raised position via magnets strategically placed on the ceiling or side or rear walls. The skilled artisan will understand that many other configurations may also be employed without departing from the spirit of the invention.

In addition, the retaining unit 65 may be omitted entirely. For example, the shelf 54 may be configured and pivotally mounted (such as on a flange extending forwardly from the rear wall 20) such that the shelf 54 pivots beyond a directly upright position and therefore can remain in the raised position by gravity alone.

Those skilled in this art will also appreciate that, although the illustrated shelf 54 is mounted such that it pivots about an axis that is generally parallel to and adjacent the rear wall 20, a shelf may also be attached such that its pivot axis is parallel to and adjacent the front wall 16 or either of the side walls 18*a*, 18*b*. In each instance, a recess (preferably, but not necessarily) in one of the side, rear or front walls can support the shelf in a lowered position. Such a shelf may include a retainer unit, or a retainer unit may be omitted. Pivotal attachment of the shelf to the walls of the container 12 may be accomplished by any of the techniques described hereinabove.

The discussion hereinabove demonstrates that the inclusion of the shelf 54 enables a user of the chest 10 to store small items on the shelf 54 when it is desirable to do so, yet also enables the user to raise the shelf 54 if such storage is not needed or if a taller storage space is required in the rear portion of the container 12. Also, the pivoting nature of the shelf 54 enables the user to more easily search for items located in the rear portion of the container.

The foregoing is illustrative of the present invention and is not to be construed as limiting thereof. Although exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. The invention is defined by the following claims, with equivalents of the claims to be included therein. In the claims, means-plus-function clauses are intended to cover the structures described herein as performing the recited function and not only structural equivalents but also equivalent structures.

That which is claimed is:

1. A storage chest, comprising:

opposing front and rear walls;

opposing side walls connecting said front and rear walls, at least one of said side walls including a recess having an upper horizontal surface; and a shelf including a main panel, said shelf being pivotally attached with at least one of said rear wall and said side walls and movable between a raised position, in which said main panel is generally upright, with a front edge of said main panel being located above a rear edge of said main panel, and a lowered position, in which said main panel is generally horizontally disposed and said shelf rests upon said upper horizontal surface of said side wall recess.

2. The storage chest defined in claim 1, wherein said recess includes a lower horizontal surface and a vertical panel extending between said upper and lower surfaces, and further comprising a handle pivotally mounted within said recess.

3. The storage chest defined in claim 1, further comprising a retaining unit that holds said shelf in the raised position.

4. The storage chest defined in claim 3, further comprising a ceiling fixed to said rear wall, and wherein said retaining unit is mounted to said ceiling.

5. The storage chest defined in claim 4, wherein said retaining unit comprises a retaining arm.

6. The storage chest defined in claim 5, wherein said retaining arm is pivotally mounted to said ceiling.

7. The storage chest defined in claim 4, further comprising a cover pivotally attached to said ceiling.

8. The storage chest defined in claim 7, wherein said cover takes a closed position in which said cover slopes downwardly from a rear edge thereof to a front edge thereof.

9. The storage chest defined in claim 1, wherein said side walls and said recess are unitary.

10. The storage chest defined in claim 1, wherein said front, rear and side walls are formed of sheet steel.

11. The storage chest defined in claim 10, wherein said shelf is pivotally attached to said rear wall.

12. A storage chest, comprising:

opposing front and rear walls;

opposing side walls connecting said front and rear walls, each of said side walls including a recess having upper and lower horizontal surfaces and a vertical panel extending therebetween;

a ceiling fixed to said rear wall and said side walls;

a pair of handles, each of which is pivotally mounted within a respective side wall recess;

a shelf including a main panel, said shelf being pivotally attached to at least one of said rear wall and said side walls and movable about a pivot axis adjacent and parallel to the rear wall between a raised position, in which said main panel is generally upright, with a front edge of said main panel being located above a rear edge of said main panel, and a lowered position, in which said main panel is generally horizontally disposed and said shelf rests upon at least one of said upper horizontal surfaces of said side wall recesses; and a retaining unit attached to said ceiling that holds said shelf in said raised position.

13. The storage chest defined in claim 12, wherein said retaining unit comprises a retaining arm.

14. The storage chest defined in claim 13, wherein said retaining arm is pivotally mounted to said ceiling.

15. The storage chest defined in claim 12, further comprising a cover pivotally attached to said ceiling.

16. The storage chest defined in claim 15, wherein said cover takes a closed position in which said cover slopes downwardly from a rear edge thereof to a front edge thereof.

17. The storage chest defined in claim 12, wherein said side walls and said recesses are unitary.

18. The storage chest defined in claim 12, wherein said front, rear and side walls are formed of sheet steel.

19. The storage chest defined in claim 18, wherein said shelf is pivotally attached to said rear wall.

20. A storage chest, comprising:

opposing front and rear walls;

opposing side walls connecting said front and rear walls, each of said side walls including a recess having upper and lower horizontal surfaces and a vertical panel extending therebetween, said front, rear and side walls being formed of sheet steel;

a ceiling fixed to said rear wall and said side walls;

a pair of handles, each of which is pivotally mounted within a respective side wall recess;

a shelf including a main panel, said shelf being pivotally attached to said rear wall and movable between a raised position, in which said main panel is generally upright, with a front edge of said main panel being located above a rear edge of said main panel, and a lowered position, in which said main panel is generally horizontally disposed and said shelf rests upon said upper horizontal surfaces of said side wall recesses; and a retaining unit attached to said ceiling that retains said shelf in said raised position.

* * * * *